US005908120A

United States Patent [19]

Yates et al.

[11] Patent Number: 5,908,120

[45] Date of Patent: Jun. 1, 1999

[54] HANGER FOR SUPPORTING ARTICLES TO BE ELECTROSTATICALLY PAINTED

[76] Inventors: Donnie Mitchell Yates, 132 Freeman Mill Rd., Hamlet, N.C. 28345; Warren Glenn Yates, 502 Old Cheraw Hwy., Rockingham, N.C. 28379

[21] Appl. No.: 08/790,990

[22] Filed: Jan. 29, 1997

[51] Int. Cl.[6] ..... A47F 5/08

[52] U.S. Cl. ..... 211/119; 118/500; 204/297 W; 211/113

[58] Field of Search ..... 211/119, 113, 211/118, 162; 204/297 W, 118, 500; 118/500

[56] References Cited

U.S. PATENT DOCUMENTS

| | | | |
|---|---|---|---|
| 2,858,265 | 10/1958 | Schneider . | |
| 2,904,492 | 9/1959 | Nali . | |
| 3,029,952 | 4/1962 | Bagdon et al. . | |
| 3,294,668 | 12/1966 | Belke . | |
| 3,357,913 | 12/1967 | Zavarella | 204/297 W |
| 3,981,471 | 9/1976 | Currier . | |
| 4,115,083 | 9/1978 | Huppi . | |
| 4,128,078 | 12/1978 | Stoltz et al. . | |
| 4,181,553 | 1/1980 | Hogg . | |
| 4,213,418 | 7/1980 | Oswald . | |
| 4,217,853 | 8/1980 | Davitz | 204/297 W X |
| 4,527,694 | 7/1985 | Bolt et al. . | |
| 4,605,988 | 8/1986 | Nienhuis et al. . | |
| 4,628,859 | 12/1986 | Hines . | |
| 4,715,314 | 12/1987 | Ramseier et al. . | |
| 4,753,014 | 6/1988 | Vrajich . | |
| 4,773,172 | 9/1988 | Fast | 40/642.01 X |
| 4,872,963 | 10/1989 | Van Horn | 204/297 W |
| 4,892,750 | 1/1990 | Soshi et al. . | |
| 5,020,677 | 6/1991 | Wirth et al. | 204/297 W X |
| 5,084,155 | 1/1992 | Engwall | 204/297 W |
| 5,136,971 | 8/1992 | Blankemeyer et al. . | |
| 5,147,050 | 9/1992 | Cullen | 211/118 |
| 5,264,255 | 11/1993 | Salisbury . | |
| 5,439,120 | 8/1995 | Brozak | 211/59.1 |
| 5,511,332 | 4/1996 | Sturkie et al. | 40/661.03 |
| 5,524,774 | 6/1996 | Cullen . | |

*Primary Examiner*—Peter M. Cuomo
*Assistant Examiner*—Stephen Vu
*Attorney, Agent, or Firm*—Michael A. Mann; Nexsen Pruet Jacobs & Pollard LLP

[57] ABSTRACT

The present invention is an electrically grounded hanger system for supporting a plurality of articles to be electrostatically coated with a paint particulate. The hanger system is supported from a grounded conveyor system and comprises a support descending from the conveyor system and several slide bars carried by the support. A plurality of hooks having a shoulder and an arm are slidably positioned within the slide bar with the arms extending through a slot within the slide bar. The shoulder of the hook engages the interior surface of the side bar in at least two contact points and the arm carries the articles to be painted. The slot extends the length of the slide bar such that the hooks are universally placeable along the length of the slide bar. In addition, by having the shoulder positioned within the interior of the slide bar, paint particulate does not accumulate or adhere to the contact points between the slide bar and the shoulder. Therefore, the support and slide bars may be used in numerous subsequent painting operations without having to be cleaned, by replacing the painted hooks if necessary.

15 Claims, 5 Drawing Sheets

30
40
40
42
60
80
70
92
92
90
90
94
94

40
92
42
66
66
70
46
46
60
62
72
80
90
94
10
10

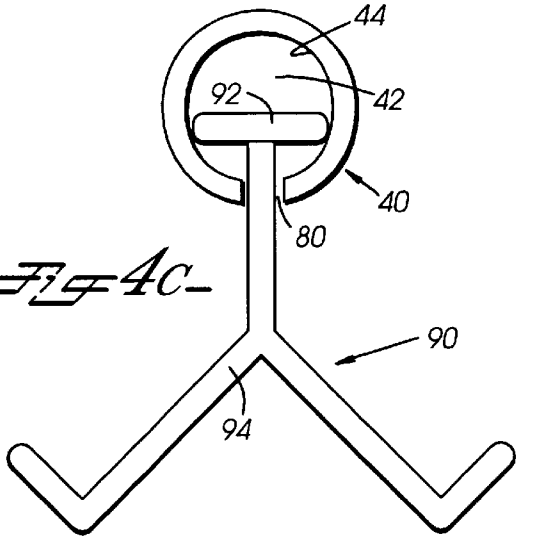
Fig-4A-
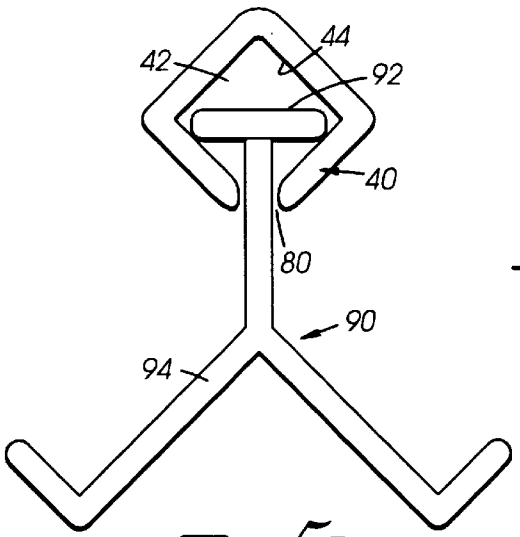
Fig-4B-
Fig-4C-
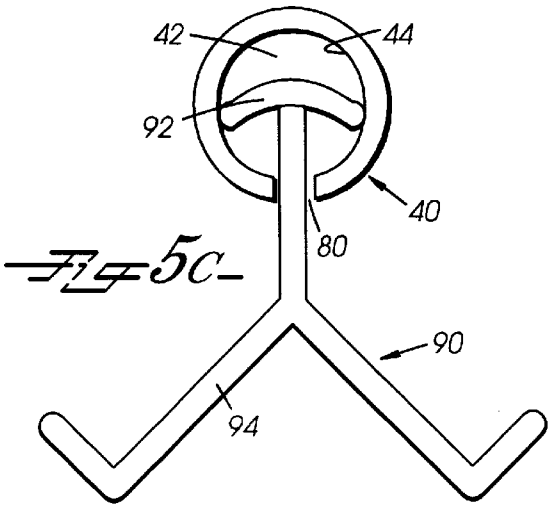
Fig-5A-
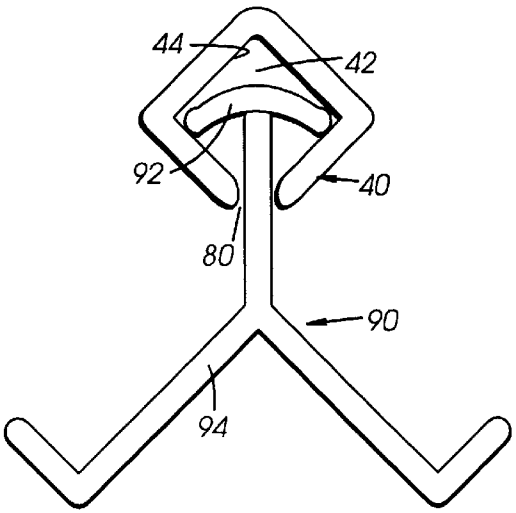
Fig-5B-
Fig-5C-

Fig 6
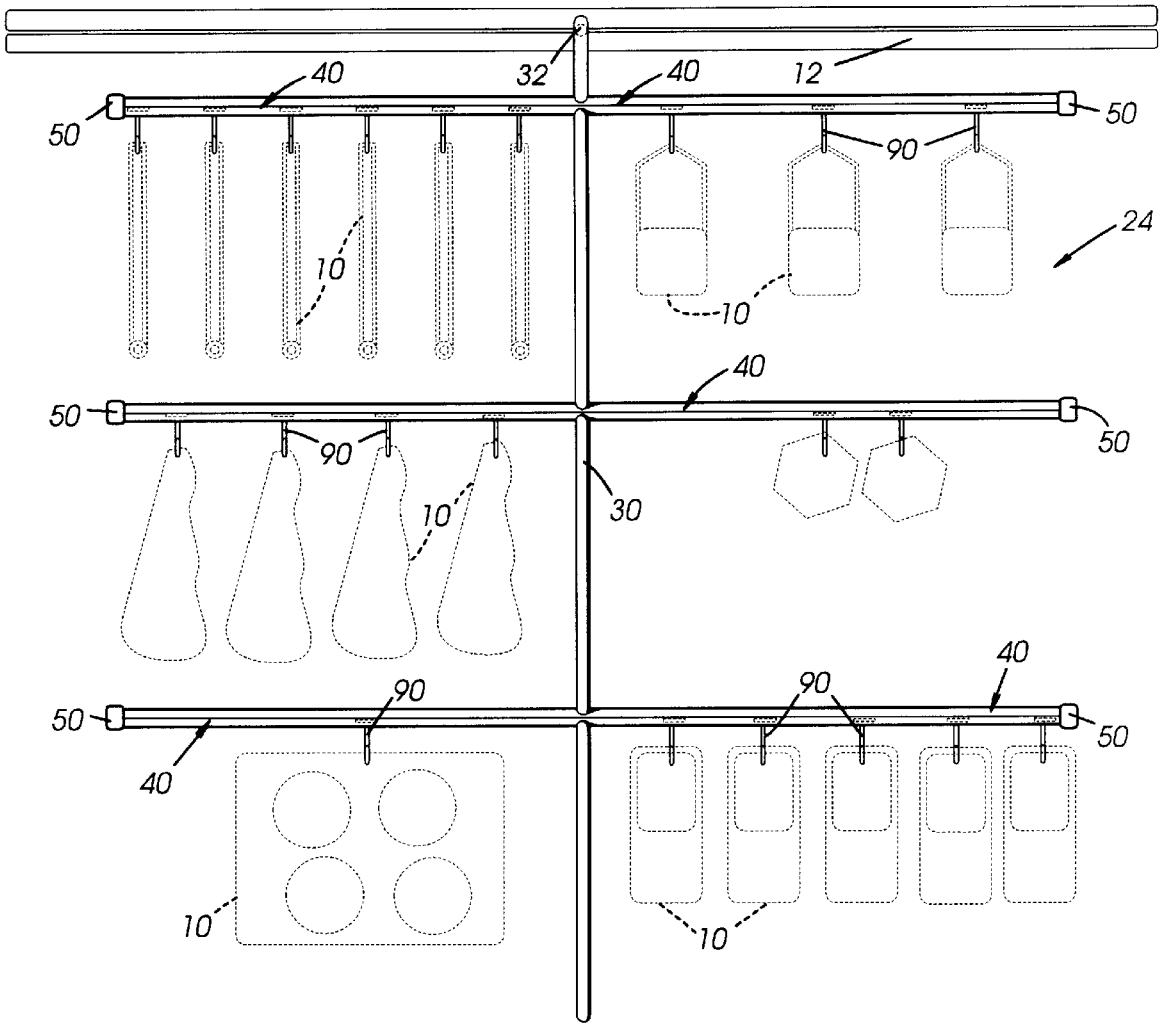
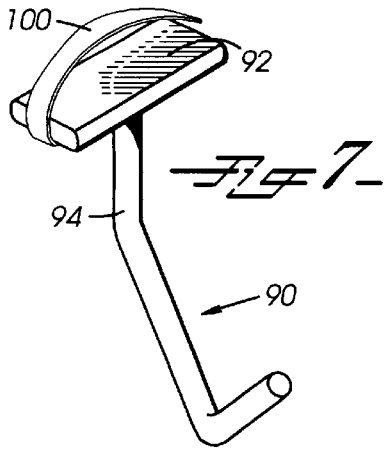
Fig 7
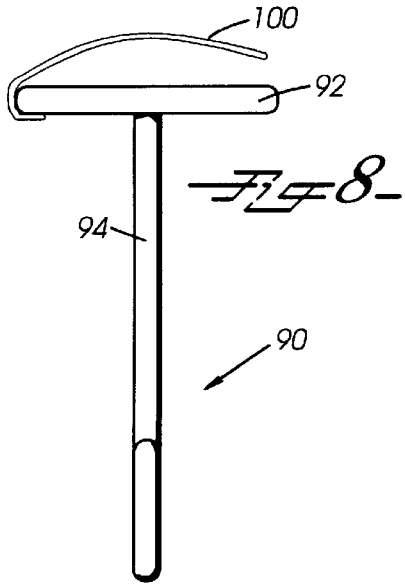
Fig 8

HANGER FOR SUPPORTING ARTICLES TO BE ELECTROSTATICALLY PAINTED

BACKGROUND OF THE INVENTION

1. Field of the Invention

The present invention relates to hangers or support racks used for supporting articles in electrically conductive contact during transport through an electrostatic finishing station. In particular, the present invention relates to support racks having universally adjustable support hooks.

2. Discussion of Background

In the powder painting industry, articles are supported on hangers and carried along by a conveyor through a finishing station, which may include the steps of cleaning, rinsing, drying, coating and baking. Usually finishing includes traveling through an electrostatic spray booth where the articles, electrostatically grounded through the hanger to the conveyor, are coated with an electrically charged paint particulate. After the articles have been coated with the paint particulate, the hangers are transported to an oven where the paint is baked onto each article.

Each painting and baking operation, in addition to applying paint to the articles, applies a coating to the exposed portions of the hanger as well as the hooks, except for a small area where the hooks contact the articles. Unless similar articles are painted in subsequent operations, where each article would be in electrical contact with the hook in the same location, it is necessary to provide a clean support hook for each subsequent operation. In addition, because the hanger is coated each time it travels through the finishing process, the electrical contact between the hooks and the hangers can become covered and damaged, thus requiring the hanger to be cleaned before using it in another coating process.

When the hooks and hangers become coated with a baked paint, the coating cannot be merely washed away or cleaned but must be either burned off or chipped away. During the baking process the articles are subjected to temperatures between approximately 300° F. and 400° F., but in order to burn the paint off, the hangers and hooks must be subjected to temperatures over 1000° F., which obviously consumes a large amount of energy. Therefore, it is important that the hangers be able to be used as many times as possible before having to be cleaned.

It is not practical to chip away the paint from the hanger, thus the paint must be burned away; however, with regard to the hooks, the paint can be chipped away. By tumbling the hooks together with stones, rocks, or some other tumblers, the paint will chip away. This is a practical and economical solution for the hooks, but it is not practical for the hangers. Consequently, it is important to provide a hanger system that optimizes the number of cycles the hanger can undergo before cleaning is necessary.

It is also important in electrostatic painting operations that the articles be in good electrical connection with the hooks and that the hooks be in good electrical connection with the hanger. In addition, because there are a variety of sizes and shapes of articles to be painted, it is important that the hanger and hooks be able to be adapted or modified to support the various articles. In other words, each hanger must have flexibility regarding the size and shape of article to be supported, otherwise the number of dedicated hangers would be enormous.

Consequently, there is a need for a hanger system that will provide flexibility and which will assure good electrical contact between the articles and hooks and, more importantly, the hooks and hangers. In addition, there is a need for a hanger system having the previous described features, but also a system which can be used numerous times or cycles without having to be cleaned.

SUMMARY OF THE INVENTION

According to its major aspects and broadly stated, the present invention is a hanger system for supporting articles from a conveyor system. The hanger system supports the articles so that each is electrically grounded to the conveyor system and thus will attract electrically charged paint particulate. In other words, the hanger system is electrically conductive, so that each article is in electrical communication with the conveyor system. The hanger system comprises a support having a catch at one end to attach to the conveyor system. The support descends from the catch and carries a plurality of slide bars that extend therefrom. A plurality of hooks are slidably positioned within the slide bars and extend through a slot therein so that the articles can be supported from the hooks.

The interaction between the slide bars and hooks is an important feature of the present invention. Each hook comprises a shoulder and an arm; and each slide bar comprises a hollow rod with the slot extending its length, so that the shoulder is slidably positioned within the interior of the slide bar and the arm extends through the slot. The shoulder engages the interior surface of the slide bar, thus forming an electrical connection between the two. In addition, by having the slot extend the length of the slide bar, each hook may be placed anywhere along the length, thus providing complete flexibility to the system.

Another important feature of the present invention is the cross-sectional shape or geometry of each slide bar. In a preferred embodiment, the slide bar has a first side and a second side, each having an end that defines the slot therebetween. The shoulder engages both the first and second sides of the slide bar and thus is in constant electrical connection with the support. In addition, the shoulder preferably engages the first and second sides proximate to the inside of an angle, where there are less surface charges. Paint particulate is attracted to areas having surface charges, and thus by reducing the surface charges to certain areas by controlling the geometry of the slide bar, the contact points where the shoulders of the hooks engage the interior surface of the slide bar remain free of paint. Consequently, the hanger can be used numerous times merely by changing the hooks, without having to clean the hanger.

Still another feature of the present invention is the design of the slot. The surface charges on the ends of the first and second side repel each other, and therefore the paint is not attracted to the ends or through the slot. Paint is inhibited from flowing into the interior of the slide bars, and thus does not interfere with the electrical connections. Specifically, while not wishing to be bound by theory, the faraday effect reduces the surface charges proximate to the ends of the slot and thus does not attract paint particulate. Therefore, the particular width of the slot can play an important role in preventing paint particulate from being attracted into the interior of the slide bar. Consequently, the design of the slot combined with the geometry of the slide bar further prevents paint from accumulating in the contact region.

In an alternative embodiment the shoulder of the hook has a spring carried on its top, which is another important feature of the present invention. The spring engages the top interior surface of the slide bar, thus biasing the shoulder downward against the interior surface of the slide bar at its contact points. The spring further assures that there is a good electrical connection between the two. Furthermore, the spring increase the frictional resistance between the shoulder and the slide bar, and thus resists the movement of the hook relative to the slide bar once the hook has been placed in position. In other words, the hook will not move along the length of the slide bar because of vibrations or other jolts, once the hook has been placed in position.

Other features and advantages of the present invention will be apparent to those skilled in the art from a careful reading of the Detailed Description of a Preferred Embodiment presented below and accompanied by the drawings.

BRIEF DESCRIPTION OF THE DRAWINGS

In the drawings,

FIG. 4A is a side view of a hanger system according to a preferred embodiment of the present invention;

FIG. 4B is a side view of a hanger system according to another preferred embodiment of the present invention;

FIG. 4C is a side view of a hanger system according to another preferred embodiment of the present invention;

FIG. 5A is a side view of a hanger system according to another preferred embodiment of the present invention;

FIG. 5B is a side view of a hanger system according to another preferred embodiment of the present invention;

FIG. 5C is a side view of a hanger system according to another preferred embodiment of the present invention;

FIG. 6 is a front view of a hanger system with a plurality of articles disposed thereon and carried by a conveyor system, according to a preferred embodiment of the present invention;

FIG. 7 is a perspective view of a hook showing a spring device attached thereto, according to another preferred embodiment of the present invention;

FIG. 8 is a front view of a hook showing a spring device attached thereto according to another preferred embodiment of the present invention;

DETAILED DESCRIPTION OF A PREFERRED EMBODIMENT

Figure 1:
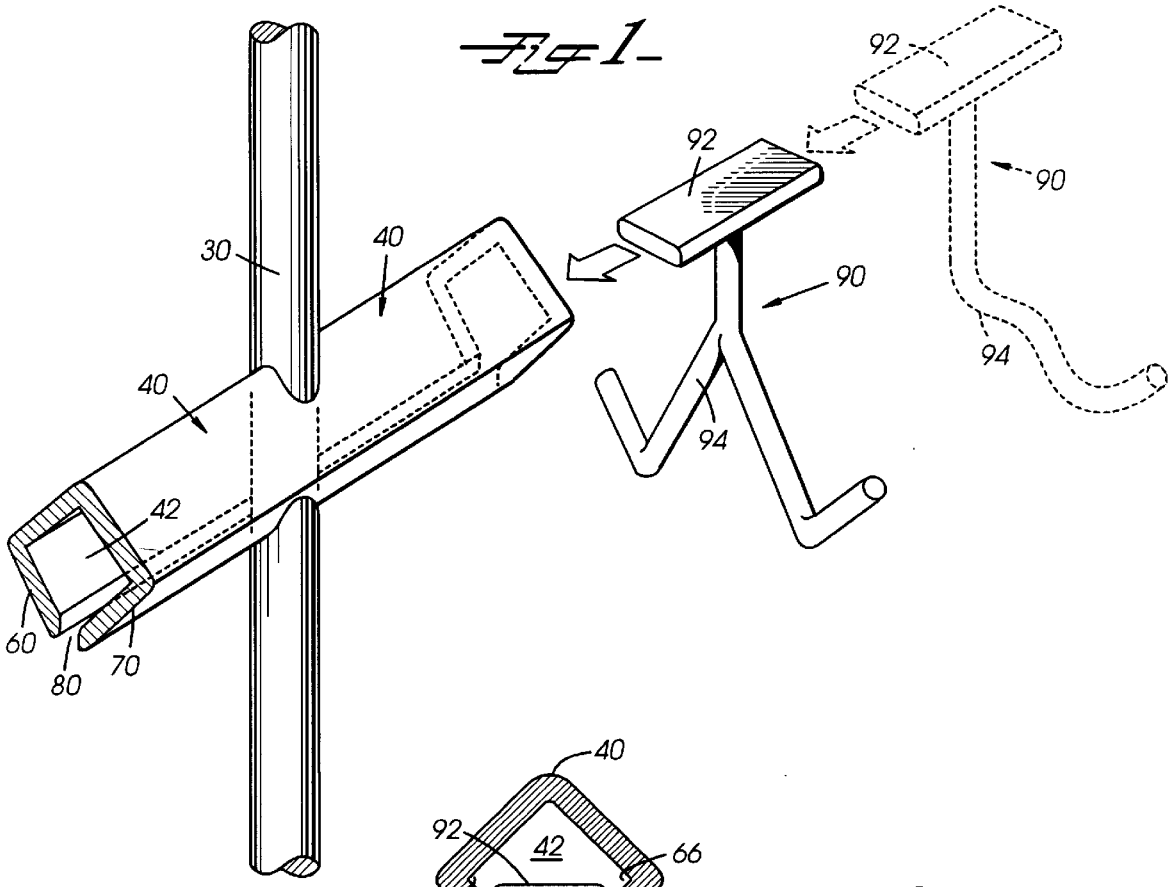
FIG. 1 is a partial perspective view of a hanger system showing the movement of a hook, according to a preferred embodiment of the present invention.
Figure 3:
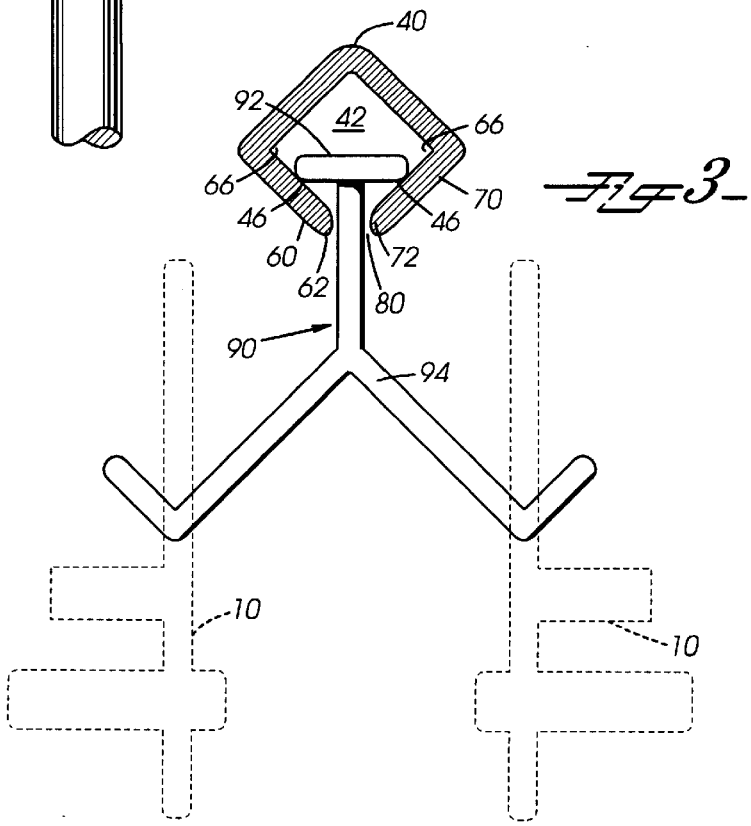
FIG. 3 is a cross-sectional view taken along line 3—3 of FIG. 2, according to a preferred embodiment of the present invention.
Figure 2:
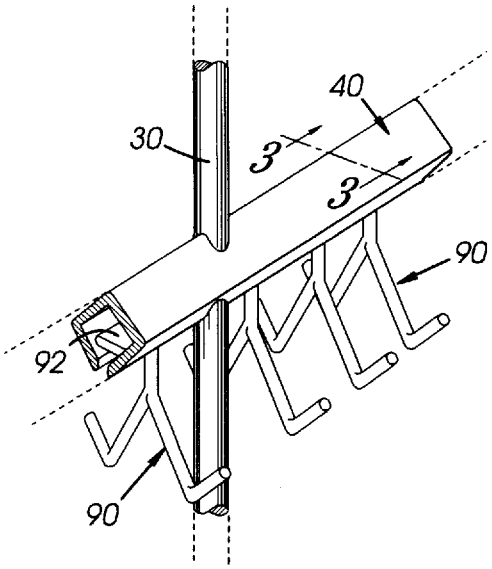
FIG. 2 is a partial perspective view of a hanger system showing the placement of hooks, according to a preferred embodiment of the present invention.

Referring now to the figures, the present invention is a hanger system 20 for supporting an article 10 from a conveyor system 12. The conveyor system 12 carries the hanger system 20 and the article 10 through a finishing station which includes a coating of electrostatically charged paint particulate. The articles 10 are electrically grounded through the hanger system 20, which is electrically conductive, to the conveyor system 12 so that the paint particulate will be attracted to the individual articles 10. After the articles 10 have been coated with paint particulate, the articles are transported via the conveyor 12 to an oven, where the paint is baked on the articles 10 and any other surface of the hanger system 20 where paint particulate may have been attracted.

The hanger system 20 comprises a support 30 having a catch 32 on one end. (See FIG. 6) Catch 32 is basically a hook that allows the hanger system 20 to be connected to and carried by the conveyor system 12. Support 30 descends from catch 32 and has a plurality of slide bars 40 extending therefrom. In the preferred embodiment, slide bars 40 extend perpendicularly from support 30, however, slide bars 40 may be designed to extend parallel to support 30 by placing slide bars 40 in spaced relation to support 30 with a spacer bar. (Not shown)

Slide bars 40 are preferably welded or otherwise attached to support 30 at their mid-section, so that the balance of hanger system 20 is maintained. As shown in FIG. 1, support 30 actually extends through slide bar 40, thus bisecting slide bar 40 into a pair of slide bars 40. However, slide bar 40 can be attached to support 30 in a variety of different ways, such that support 30 does not bifurcate slide bar 40 into two separate slide bars 40.

It should also be noted that slide bars 40 may be placed anywhere along the length of support 30. In other words, as shown in FIG. 6, there are six slide bars 40 extending from support 30, three from each side; however, there may be a greater or fewer number of slide bars 40, and slide bars 40 do not have to be evenly distributed along the length of support 30 or equally on the sides of support 30. While the hanger system 20 may be unevenly balanced when unloaded, once articles 10 have been placed thereon, the balance of hanger system 20 may be adjusted by the specific placement of articles 10. In addition, it may be necessary to design support 30 with an unequal distribution of slide bars 40 depending on the particular size and shape of articles 10 to be carried. These modification and changes are contemplated within this disclosure and are within the spirit and scope of the present invention.

Slide bar 40 comprises a first side 60 and a second side 70 which are joined at one end and are not joined at their other ends 62, 72 respectively. There is a slot 80 defined by the area between the ends 62, 72 of first side 60 and second side 70. As shown in the figures, there are several preferred cross-sectional shapes for slide bar 40. In particular, in FIGS. 1–3, 4B and 5B, slide bar 40 is four sided, having the approximate construction of a square (or rectangular) tube with one corner open to define slot 80; in FIGS. 4A, 5A and 13, slide bar 40 is five sided; and in FIGS. 4C and 5C, slide bar 40 is cylindrical. Regardless of the specific geometry of slide bar 40 disclosed above, each construction of slide bar 40 has a slot 80 extending approximately its total length. Those of ordinary skill in the art will recognize that in some circumstances and designs slot 80 may be prevented from extending the length of slide bar 40 by support 30.

Furthermore, slide bar 40 is preferably constructed from an extruded metal that is electrically conductive.

In each embodiment of slide bar 40, slide bar 40 comprises an interior 42 and an interior surface 44. In the embodiments where slide bar 40 has either four sides or five sides, first side 60 and second side 70 comprise at least two sides of the four or five sides of slide bar 40, and first side 60 and second side 70 have therein a first angle 64 and second angle 74, respectively. First and second angles 64, 74 each have an inside 66, 76 respectively, and from the perspective of insides 66, 76 angles 64, 74 are less than 180°.

As shown in the figures, there are a plurality of hooks 90 disposed within slide bar 40. Each hook 90 comprises a shoulder 92 and an arm 94, where shoulder 92 is slidably positioned within the interior 42 of slide bar 40. Shoulder 92 engages the interior surface 44 of slide bar 40 at preferably at least two contact points 46. Furthermore, these contact points 46 are preferably proximate to the insides 66, 76 of first angle 64 and second angle 74, respectively. In the embodiment where slide bar 40 has a cylindrical shape, contact points 46 are along the interior surface 44 of slide bar 40, as shown in FIGS. 4C and 5C.

Figure 9A:
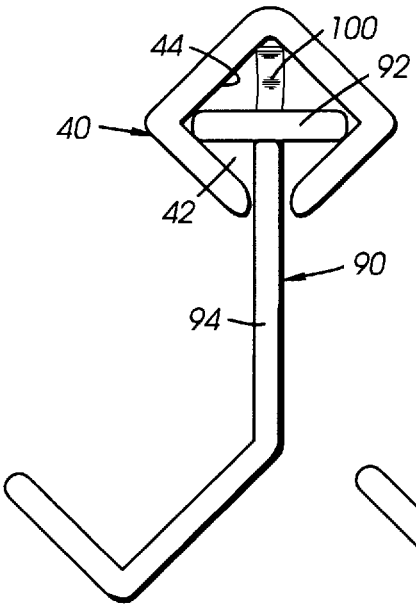
FIG. 9A is a side view of a hanger system according to another preferred embodiment of the present invention.
Figure 9B:
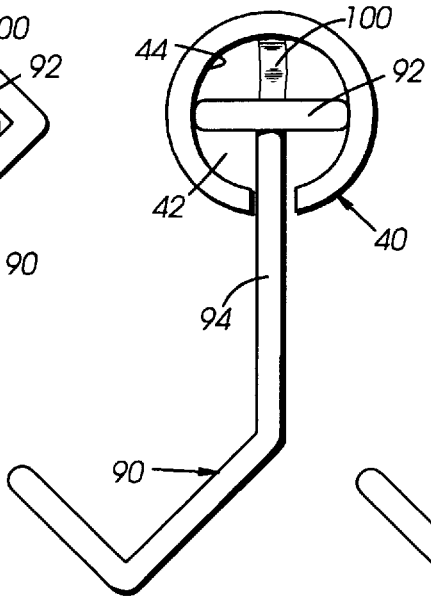
FIG. 9B is a side view of a hanger system according to another preferred embodiment of the present invention.
Figure 9C:
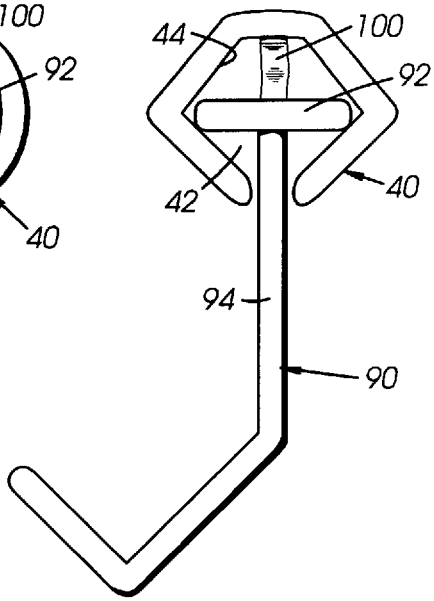
FIG. 9C is a side view of a hanger system according to another preferred embodiment of the present invention.
Figure 14:
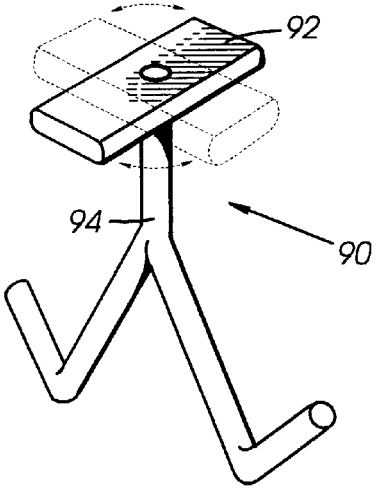
FIG. 14 is a perspective view of a hook according to another preferred embodiment of the present invention.

Arm 94 extends from shoulder 92 through slot 80 and is curved or bent at its end so that articles 10 may be placed thereon. Those of ordinary skill in the art will recognize that there are numerous possible designs and configurations for arms 94 that may be used and that are used in the art for supporting articles 10 from hanger system 20. For instance, in FIGS. 4 and 5, a two-sided arm 94 is shown, while in FIGS. 9A, B and C, a one-sided arm 94 is shown. In addition, arm 94 may be rotatably connected to shoulder 92, as shown in FIG. 14, so that arm 94 may be rotated relative to shoulder 92 and slide bar 40. Furthermore, hooks 90 are preferably constructed from stainless steel.

Figure 10:
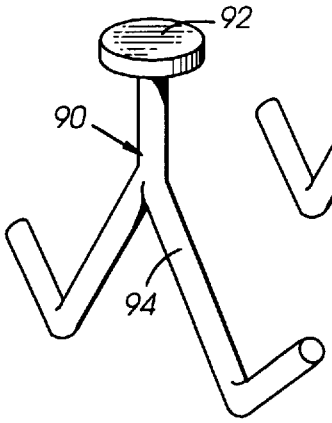
FIG. 10 is a perspective view of a hook according to another preferred embodiment of the present invention.
Figure 11:
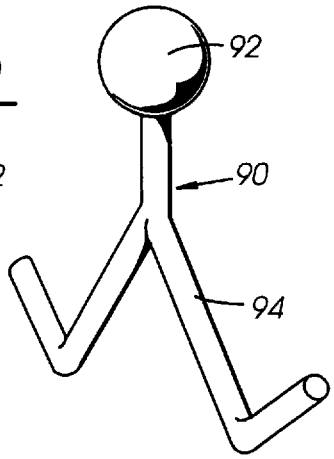
FIG. 11 is a perspective view of a hook according to another preferred embodiment of the present invention.
Figure 12:
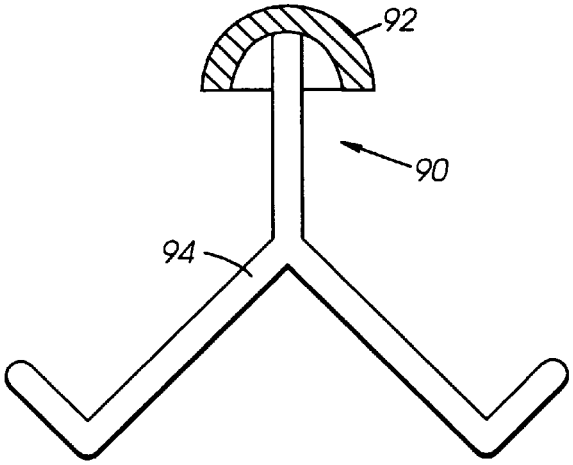
FIG. 12 is a cross-sectional view of a hook according to another preferred embodiment of the present invention.

There are several designs for shoulder 92 that may be used without departing from the spirit and scope of the present invention. In the preferred embodiment, shoulder 92 is a rectangular bar of conductive metal with arm 94 attached thereto. In addition, as shown in FIGS. 5A, B, and C, the rectangular bar design of shoulder 92 can be bent to form an arcuate shape. With this design, contact points 46 between shoulder 92 and first side 60 and second side 70 are preferably proximate to first angle 64 and second angle 74. Furthermore, shoulder 92 may be designed having a flat circular disk (FIG. 10), a spherical ball (FIG. 11), or a curved circular disk (FIG. 12, approximately hemispherical), along with many more. In all of the designs, shoulder 92 is slidably positioned within interior 42 of slide bar 40, such that shoulder 92 can slide approximately the total length of slide bar 40 with arm 94 correspondingly sliding through slot 80.

In another preferred embodiment, as illustrated in FIGS. 7, 8, and 9A–C, a spring 100 is attached to shoulder 92. When in position within the interior 42 of slide bar 40, spring 100 engages the top of interior surface 44 and biases shoulder 92 downward against first side 60 and second side 70. Spring 100 serves two functions; first, by forcing shoulder 92 downward against the interior 42 of slide bar 40, shoulder 92 is maintained in electrical contact with first and second sides 60, 70 of slide bar 40; and second, spring 100 provides frictional resistance between shoulder 92 and interior surface 44 of slide bar 40 when hook 90 is moved relative to slide bar 40. In the first instance, it is important that there be a good electrical connection between slide bar 40 and hook 90, so that the article 10 carried by hook 90 will also be electrically grounded. In the second instance, it is important that hooks 90 not slide about within slide bar 40 as conveyor system 12 transports hanger system 20 through the finishing process.

In the figures, spring 100 is a leaf or flat spring and is attached to shoulder 92 at one of its ends, but cantilevered at its other. Spring 100 deflects under a load, thus biasing shoulder 92 in the downward direction. However, it will be recognized that other mechanical springs may be used without departing from the spirit and scope of the present invention.

Figure 13:
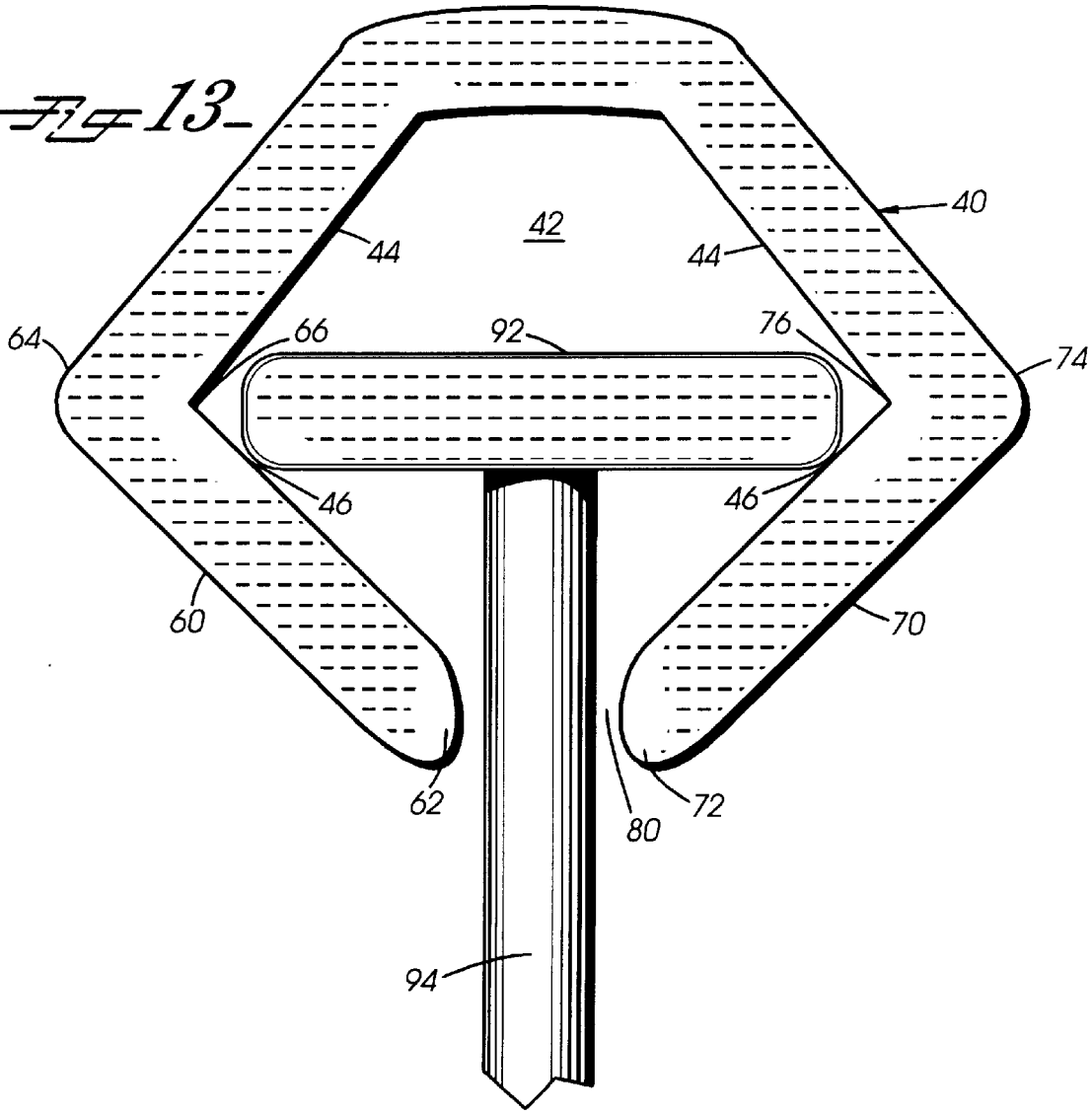
FIG. 13 is a detail view of a side view of a hanger system illustrating the distribution of surface charges on the slide bar, according to a preferred embodiment.

During the electrostatic coating operation, it is important for there to be a good electrical connection between the conveyor system 12 and the article 10 supported by the hanger system 20, so that the electrostatically charged paint particulate will adhere to the article 10. However, every time the hanger system goes through the coating process, paint particulate is not only applied to the articles 10 but also to the complete hanger system 20. Therefore, the support 30, slide bar 40, and hooks 90 are coated with paint, but because shoulder 92 is hidden within the interior 42 of slide bar 40, very little paint adheres to the contact points 46 between shoulder 92 and slide bar 40. The structural design of slide bar 40 limits the amount of paint that penetrates into this region, but the faraday effect and the distribution of surface charges on slide bar 40 also inhibit the adherence of paint to these regions. In particular, as shown in FIG. 13, the surface charges, shown as negatives, typically repel one another and migrate to areas that permit them to have the greatest amount of space between one another. The areas having very little surface charges are typically located on the inside of angles or other bends and where two or more parts are in contact. In the insides 66, 76 of first angle 64 and second angle 74, respectively, the surface charges are repelled from each other along with the areas proximate to the contact points 46. The absence of surface charges means that it is less likely that paint particulate will adhere in these regions. Consequently, after the hanger system 20 has undergone a coating step, the only area where the electrical connection between the conveyor system 12 and article 10 might degrade would be the contact point between the article 10 and arm 94.

If similar parts are to be coated on successive operations, then it may not be necessary to change hooks 90, but if different parts are to be coated, it might be necessary to replace hooks 90 with clean hooks 90, so that there will be a good electrical connection between hooks 90 and article 10. If hooks 90 need to be replaced, hooks 90 may be slid within slide bar 40 to their end distal to support 30 and removed. A clean hook 90 may then be replaced within slide bar 40. In addition, the distal ends of slide bar 40 may be provided with a cap 50 to prevent hooks 90 from inadvertently falling out of slide bar 40. Cap 50 can be either screwed onto slide bar 40 or frictionally slid into place.

Even though support 30 and slide bar 40 may not need to be cleaned very often, hooks 90 will need to be cleaned much more often. The present invention enables the hooks 90 to be cleaned by tumbling them together with rocks or other heavy tumblers to chip away the baked-on paint. Furthermore, in some instances when tumbling hooks 90 alone, shoulder 92 itself is sufficient to chip away the paint from arms 94. Consequently, there is a significant energy savings by not having to burn away the paint from the hooks 90. More importantly, however, there is an even greater energy savings by not having to repetitively burn away the paint from the remaining portions of the hanger system 20. Specifically, while in normal practice it may be necessary to burn off the paint of the complete hanger system after two or three uses, the present invention remains effective even after more than ten to fifteen uses.

While the energy savings is incentive enough for the present invention, the design of the slide bar 40 also allows the hooks 90 to be placed anywhere along the length of slide bar 40. In other words, hooks may be universally adjusted along the length of slide bar 40 to carry varying size and shape of article 10 while still retaining the other benefits discussed above. The universal placement of the hooks 90 relative to slide bar 40 is especially important, because a specific hanger system 20 may be used for a variety of different articles 10, thus removing the need for having a dedicated hanger for each specific article 10. (See FIG. 6) This feature reduces the number of hanger systems 20 needed for a certain facility, while reducing the storage space that would be necessary if there were dedicated hanger systems 20.

It will be apparent to those skilled in the art that many changes and substitutions can be made to the preferred embodiment herein described without departing from the spirit and scope of the present invention as defined by the appended claims.

What is claimed is:

1. A hanger system for supporting an article from a conveyor system, said hanger system comprising:

a support adapted to be carried by the conveyor system;

a slide bar carried by said support, said slide bar having a first side and a second side defining an interior therebetween, said first side and said second side having spaced-apart ends defining a slot therebetween extending approximately the length of said slide bar;

a hook having an arm and a shoulder, said arm is pivotally attached to said shoulder, said shoulder slidably positioned anywhere along said interior of said slide bar so that said arm extends through said slot and said shoulder engages said first side and said second side of said slide bar, and wherein said arm is adapted to support the article in electrical contact to the conveyor system and said slot is dimensioned to receive a plurality of hooks.

2. The hanger system as recited in claim 1, wherein said first side has a first angle therein and said second side has a second angle therein, said first angle and said second angle having an inside, said shoulder contacting said first side and said second side proximate to said inside of said first and said second angle.

3. The hanger system as recited in claim 1, further comprising a plurality of said slide bars, said plurality of said slide bars extending approximately perpendicularly from said support.

4. A hanger system for supporting an article from a conveyor system, said hanger system comprising:

a support adapted to be carried by the conveyor system;

a slide bar carried by said support, said slide bar having an interior, an interior surface, and a slot;

hook means adapted to be slidably positioned within said slide bar and extending through said slot for adaptively holding the article in electrical contact to the conveyor system;

a spring carried by said hook means, said spring engaging said interior surface of said slide bar and biasing said hook means against said interior surface of said slide bar;

said hook means further comprises a hook having a shoulder and an arm, said shoulder engaging said interior surface of said slide bar, and said arm extending through said slot and adapted to support the article.

5. The hanger system as recited in claim 4, wherein said hook means is rotatable relative to said slide bar.

6. The hanger system as recited in claim 4, wherein said support is adapted to carry a plurality of said slide bars.

7. The hanger system as recited in claim 4, further comprising a plurality of said slide bars, said plurality of said slide bars extending approximately perpendicularly from said support.

8. The hanger system as recited in claim 4, wherein said supporting means contacts said interior surface of said slide bar in at least one contact point.

9. The hanger system as recited in claim 4, wherein said slide bar has a cylindrical shape.

10. The hanger system as recited in claim 4, wherein said spring is a leaf spring.

11. The hanger system as recited in claim 10, wherein said supporting means further comprises a hook having a shoulder and an arm, said shoulder engaging said interior surface of said slide bar, and said arm extending through said slot and adapted to support the article; wherein said spring extends from said shoulder and engages said interior surface of said slide bar.

12. The hanger system as recited in claim 4, wherein said slide bar has a first side having a first angle therein and a second side having a second angle therein, said first angle and said second angle having an inside, said hook means contacting said first side and said second side proximate to said inside of said first and said second angle.

13. The hanger system as recited in claim 12, wherein said supporting means is rotatable relative to said slide bar.

14. A hanger system for supporting an article from a conveyor system, said hanger system comprising:

a support adapted to be carried by the conveyor system;

a slide bar carried by said support, said slide bar having a first side and a second side defining an interior therebetween, said first side and said second side having spaced-apart ends defining a slot therebetween;

a hook having an arm and a shoulder, said shoulder formed to rotate within said slide bar, said shoulder slidably positioned within said interior of said slide bar so that said arm extends through said slot and said shoulder engages said first side and said second side of said slide bar, and wherein said arm is adapted to support the article in electrical contact to the conveyor system.

15. The hanger system as recited in claim 14, wherein said arm is pivotally attached to said shoulder.

* * * * *

UNITED STATES PATENT AND TRADEMARK OFFICE

CERTIFICATE OF CORRECTION

PATENT NO. : 5,908,120

DATED : JUNE 1, 1999

INVENTOR(S) : DONNIE MITCHELL YATES

It is certified that error appears in the above-identified patent and that said Letters Patent is hereby corrected as shown below:

On the title page item [76],

Inventor: Donnie Mitchell Yates, 132 Freeman Mill Rd., Hamlet NC 28345

Signed and Sealed this

Twenty-sixth Day of September, 2000

*Attest:*

Q. TODD DICKINSON

*Attesting Officer*

*Director of Patents and Trademarks*